US007100245B2

(12) United States Patent
Wohlfarth

(10) Patent No.: US 7,100,245 B2
(45) Date of Patent: Sep. 5, 2006

(54) HINGE FOR A MOTOR-VEHICLE DOOR

(76) Inventor: Klaus Wohlfarth, Aspachweg 16, Fichtenberg (DE) 74427

( * ) Notice: Subject to any disclaimer, the term of this patent is extended or adjusted under 35 U.S.C. 154(b) by 0 days.

(21) Appl. No.: 10/998,419

(22) Filed: Nov. 29, 2004

(65) Prior Publication Data

US 2005/0204511 A1 Sep. 22, 2005

(30) Foreign Application Priority Data

Mar. 17, 2004 (DE) ..... 10 2004 014 381
May 14, 2004 (DE) ..... 10 2004 024 842

(51) Int. Cl.
*E05D 3/10* (2006.01)

(52) U.S. Cl. ..... 16/367; 16/368

(58) Field of Classification Search ..... 16/351, 16/358, 368, 367, 247, 256, 280, 297, 313, 16/332, 343, 348; 49/190–192, 226, 232, 49/240, 246; 403/61, 119; 296/146.11–146.13, 296/96

See application file for complete search history.

(56) References Cited

U.S. PATENT DOCUMENTS 1,278,502 A 9/1918 Plummer
2,178,908 A 11/1939 Hudson
2,374,697 A 5/1945 Palisano et al.
3,589,069 A * 6/1971 Lecomte ..... 49/257
3,628,216 A * 12/1971 Savell ..... 16/287
3,693,997 A * 9/1972 Dreyer ..... 280/775
3,848,293 A * 11/1974 Marchione et al. ..... 16/297
4,513,475 A 4/1985 Fenton
6,030,025 A * 2/2000 Kanerva ..... 296/146.12
6,052,870 A 4/2000 Hagenlocher et al.
6,086,137 A * 7/2000 Leschke et al. ..... 296/146.1
6,386,613 B1 5/2002 Vader
6,447,043 B1 * 9/2002 VandenHeuvel et al. ..... 296/76
6,606,763 B1 * 8/2003 Bruckner ..... 16/366
6,676,193 B1 * 1/2004 Hanagan ..... 296/146.11
6,695,395 B1 2/2004 Kallio
6,808,223 B1 10/2004 Baum et al.
6,811,209 B1 11/2004 Woollett et al.
6,820,918 B1 * 11/2004 DeBono ..... 296/146.11
6,845,547 B1 1/2005 Ham (Continued)

FOREIGN PATENT DOCUMENTS

DE G 85 20 432 U1 10/1986

(Continued)

OTHER PUBLICATIONS

German search report (s.n. 10 2004 014 381.1) dated Mar. 17, 2004.

(Continued)

*Primary Examiner*—Robert J. Sandy
*Assistant Examiner*—Andre' L. Jackson
(74) *Attorney, Agent, or Firm*—Quarles & Brady LLP

(57) ABSTRACT

The invention proposes a hinge to be exchanged for the hinges on a motor-vehicle door. The hinge contains a hinge section that is attached to the bodywork and a hinge section that is attached to the door. A linking device having a pair of linkages is situated between the two hinge sections. The first linkage allows opening the door in the factory-standard manner until the door is clear of the door frame. The second linkage then allows pivoting the door upward about a horizontal axis, which will allow configuring automobile doors such that they may be opened in the same manner as "gull-wing" doors. The motions about both axes may be constrained such that contact between the door and the bodywork will be avoided.

18 Claims, 8 Drawing Sheets

U.S. PATENT DOCUMENTS

2004/0256882 A1 12/2004 McRobert

FOREIGN PATENT DOCUMENTS

Figure 1:
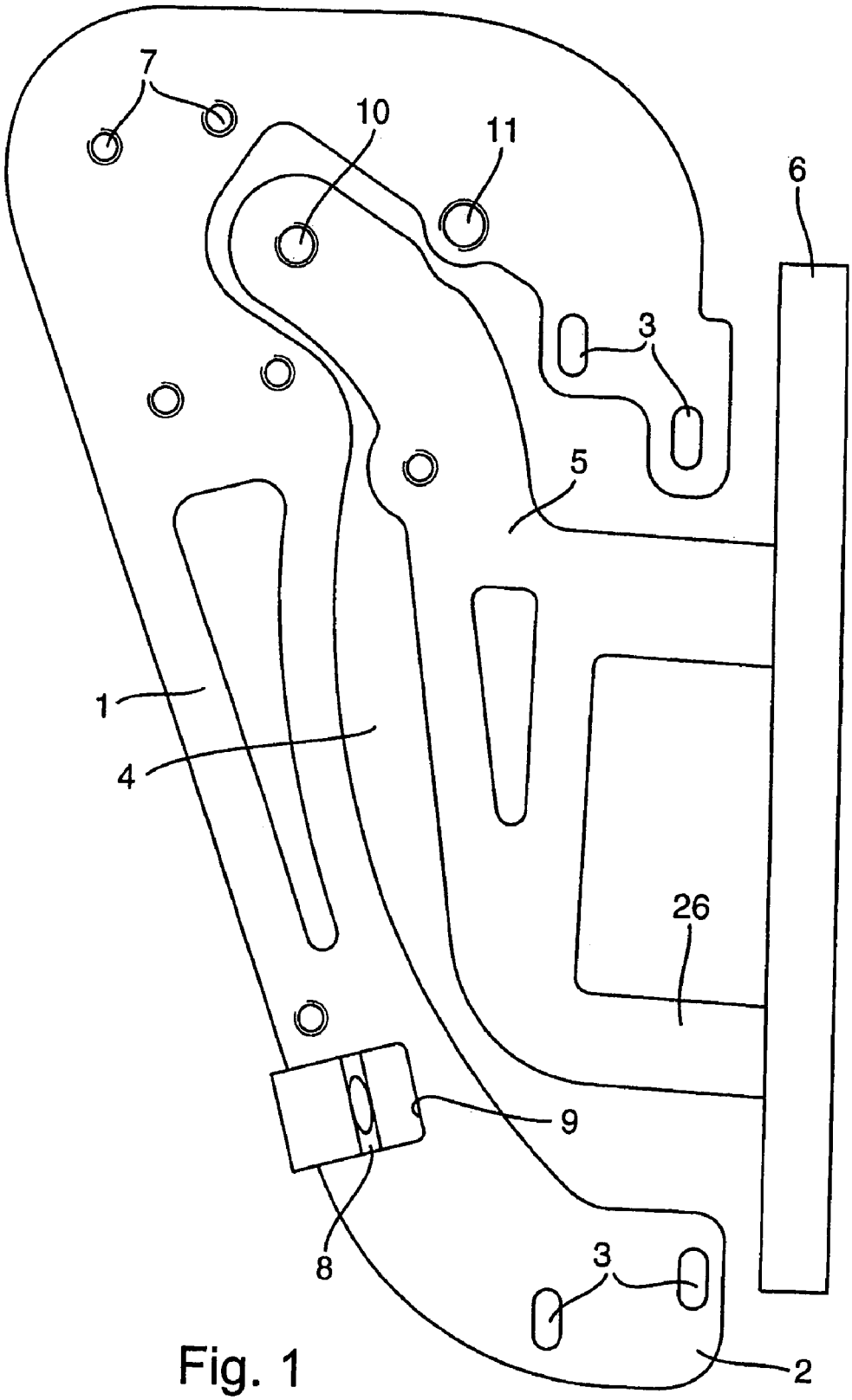

| | | | |
|---|---|---|---|
| DE | 42 06 288 | A1 | 9/1993 |
| DE | G 93 05 933 | U1 | 10/1994 |
| DE | 43 19 662 | A1 | 12/1994 |
| DE | 44 32 022 | A1 | 3/1996 |
| DE | 295 06 597 | UA | 10/1996 |
| EP | 0 493 225 | A1 | 7/1992 |
| FR | 2 694 244 | A1 | 7/1992 |
| FR | 2 699 126 | A1 | 12/1992 |

OTHER PUBLICATIONS

German search report (s.n.10 2004 024 842.7) dated Aug. 5, 2004.

* cited by examiner

HINGE FOR A MOTOR-VEHICLE DOOR

The invention relates to a hinge for a motor-vehicle door.

In most cases, motor-vehicle doors are hung on hinges situated in the vicinities of their forward edges such that they may be opened by pivoting them about a vertical axis. Doors whose hinge axes were formed at their rear edges were also common in former years. Such doors have become modern once again, and are used as rear doors on motor vehicles.

In the case of sports cars, there are also cases where their doors may be opened by pivoting them about an upper, horizontal axis running along the motor vehicle's longitudinal axis. Such doors are also termed "gull-wing doors."

Recently, doors that may be opened by pivoting them about a horizontal axis running transverse to motor vehicles' longitudinal axes have also become known. Such doors have short lateral dimensions.

The problem addressed by the invention is creating a hinge that will allow another type of opening motion, namely, in the case of a motor vehicle having normal doors, a pivoting of the doors about an approximately horizontal axis running transverse to the vehicle's longitudinal axis.

In order to solve that problem, the invention proposes a hinge having those features stated under claim 1. Elaborations on the invention are covered under subclaims.

Since normal door hinges of the type that are factory standard equipment on motor vehicles define a single axis, about which doors may be pivoted, the invention thus proposes a hinge having a linking device that forms a pair of linkages. The pair of linkages may be combined. Employing a pair of linkages on a linking device allows configuring the opening motion of the door when it commences to agree with the factory-standard motion, since the door is, of course, arranged in a door frame that surrounds the door. Seals and, if necessary, switches that are supposed to be actuated when the door is opened or closed as well, are arranged in this door frame. The door may only be moved out of the door frame by translating it in a certain direction that is determined by the factory-standard hinges involved. Of course, the same also applies to closing the door. The door cannot be moved in another direction using the linking device's second linkage until it has been moved sufficiently far out of the door frame that it is clear of the bodywork.

Under an elaboration on the invention, it may be provided that the pair of pivot axes do not intersect, which will provide that the axis of the linkage, about which the door is to be subsequently pivoted, will also be moved out of the door frame when the door starts to open.

According to the invention, under an elaboration thereon, the hinge may have a guide that at least partially constrains the motion of the linking device such that pivoting is confined to just one of the two axes over certain portions of the motion, which is intended to provide that the user practically automatically performs the correct opening motion of the door. At the start of the opening motion, the door will thus be moved in the same manner as a conventional automobile door and will not be pivoted about the axis of the second linkage, in particular, pivoted upward, until it is clear of the bodywork. During this second motion, the guide provides that the door may not longer be pivoted inward about the first axis, which could lead to it coming into contact with the bodywork. However, the guide may be configured such that both motions may occur simultaneously at a transition zone falling between the two motions.

According to the invention, the hinge, together with its linking device, may have a neutral position corresponding to the case where the door is closed and a terminal position corresponding the case where the door is fully opened. The neutral position corresponds to the case where the door is closed, in which case, a specific definition of the neutral position of the linking device will be unnecessary, since the door already has a neutral position.

According to the invention, under an elaboration thereon, the guide may be configured such that, starting from the neutral position, the linking device will initially allow a pivoting about the axis correlated to hinge section intended to be attached to the bodywork only in order that the door will be moved out of the door frame until it is fully clear of the latter.

Under a further elaboration on the invention, the guide may be configured such that, starting from the terminal position corresponding to the case where the door is fully opened, the only pivoting allowed will be a pivoting about the axis correlated to the hinge section intended to be attached to the door.

The invention proposes that the linkage axis correlated to the hinge section intended to be attached to the bodywork run roughly parallel to the hinge section intended to be attached to the bodywork. That axis may, for example, be vertical, or nearly vertical, depending upon how the door has been manufactured.

In order to set up the hinge proposed by the invention such that varying manufacturing tolerances on doors and bodywork may also be accommodated, according to the invention, it may be provided that the orientation of the linkage axis correlated to the hinge section intended to be attached to the bodywork is. adjustable with respect to that hinge section, which will allow being able to set up the door in the neutral position of the hinge section such that the same gap widths will be present all around the door.

Under an elaboration on the invention, it may be provided that the angular range through which the linking device may be pivoted about the linkage axis correlated to the hinge section intended to be attached to the bodywork and/or about the linkage axis correlated to the hinge section intended to be attached to the door is restricted at at least one end. Since the door has a well-defined closed position within the door frame, the angular range through which the linking device may be pivoted need not be accurately restricted.

The invention also proposes that the restriction on that angular range be configured such that it will be adjustable.

Since the hinge proposed by the invention may be retrofitted to motor vehicles whose doors are normally held in place by a pair of hinges arranged one above the other, the invention further proposes that, under an elaboration thereon, a supporting device that is situated at a distance from the linking device be attached to the hinge. The purpose of that supporting device is supporting the hinge section intended to be attached to the door on the hinge section intended to be attached to the bodywork while the linking device is in its neutral position. Although the linking device may beneficially be arranged on the upper end of the hinge, since the pivot axis for the raising of the door should be as far above the ground as possible, the supporting device is arranged on the upper end of the hinge. Furthermore, the supporting device need only come into play while the door is in the closed position, which corresponds to neutral position of the linking device.

It will be particularly sensible if the supporting device is configured in the form of a linkage, as is also proposed as one possibility by the invention. The supporting device axis may then also act as a linkage over that portion of the opening motion of the door for which only a pivoting about the axis correlated to the hinge section intended to be attached to the bodywork takes place, where the linkage has an axis correlated to the hinge section intended to be attached to the bodywork and an axis constituting a coaxial extension of the axis of the first linkage.

According to the invention, under an elaboration thereon, it may be provided that the supporting device/third linkage will act as a linkage only while the linking device is in its neutral position and will be extended when the latter leaves its neutral position.

For example, the supporting device may have a head that may be inserted into a socket. Such linkages are usually configured in the form of a sort of ball-joint linkage. However, unlike a ball-joint linkage, in this case, the configuration is chosen such that its head may be withdrawn from the socket. Furthermore, pivoting about several axes will be neither necessary nor desirable, which means that a sort of cylindrical head inserted into a cylindrical socket will be feasible. However, components having spherical shapes are commercially available and may be employed here.

The invention proposes that the hinge section intended to be attached to the bodywork be configured in the form of a planar component.

In the case of the hinge section intended to be attached to the door, according to the invention, it may be provided that it has a pair of angled sections, one section of which lies in the same plane as the hinge section intended to be attached to the bodywork when the linking device is in its neutral position. The hinge section intended to be attached to the bodywork may even have a notch, in which the corresponding section of the hinge section intended to be attached to the door resides.

The hinge may have a latching mechanism in order to hold the door in the opened state. Attachment of a gas spring that will facilitate opening the door is also one of the measure proposed by the invention, under an elaboration thereon.

That the hinge proposed by the invention is intended for use on a door that is to be pivoted outward about an approximately vertical axis has already been mentioned. The invention thus proposes that, under an elaboration thereon, the hinge have a latching mechanism that acts between the pair of hinge sections and latches the door in place in its closed position in the vicinity of its bottom edge, which will simulate the lower hinge normally present there when the door is in its closed state. That latching mechanism is beneficially configured such that it will release as soon as the door is pivoted outward, about the vertical axis, in order that the door may then be pivoted upward, about a horizontal axis.

For example, that latching mechanism may have a protrusion on one hinge section and a mating notch on the other hinge section. Both components, i.e., both the protrusion and the notch, should beneficially have undercut edges in order that latching will occur. The latching mechanism will prevent even slight pivoting of the door about the horizontal pivot axis.

Under a further elaboration on the invention, the hinge may have a guide in order to prevent the door from striking the bodywork or even coming into contact therewith when an upward pivoting thereof commences. That guide may, for example, be provided in the form of a sort of gate situated in the vicinity of the upper edge of the hinge.

Figure 2:
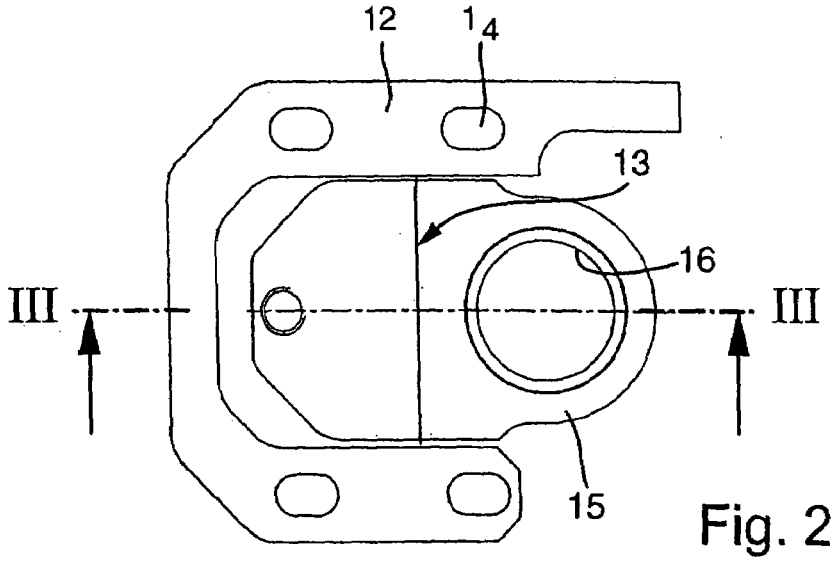
Figure 3:
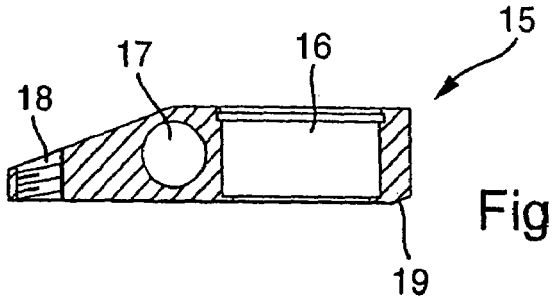
Figure 4:
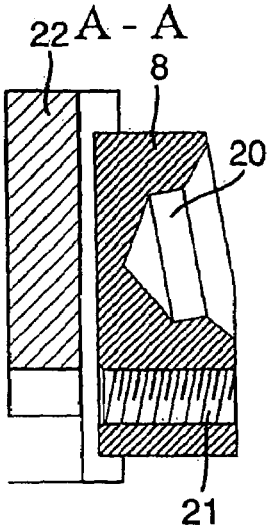
Figure 4:
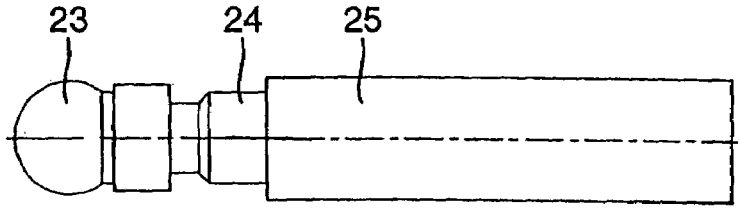
Figure 5:
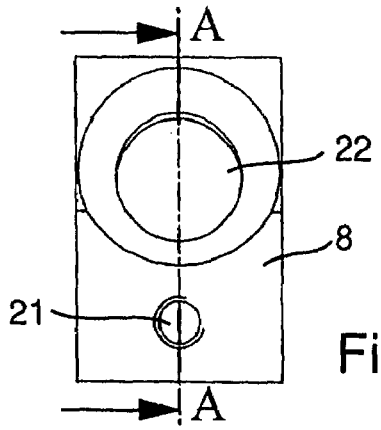
Figure 6:
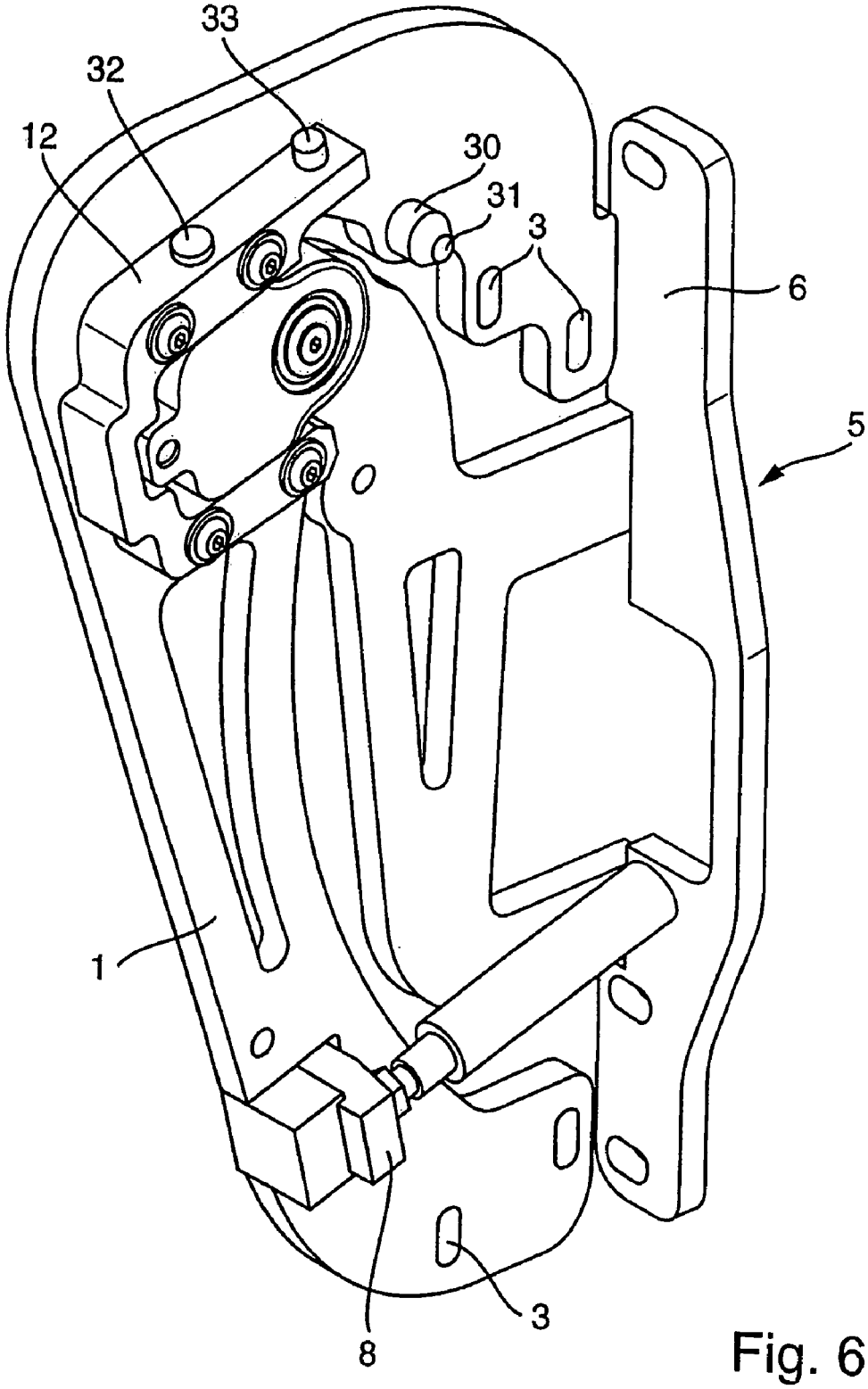
Figure 7:
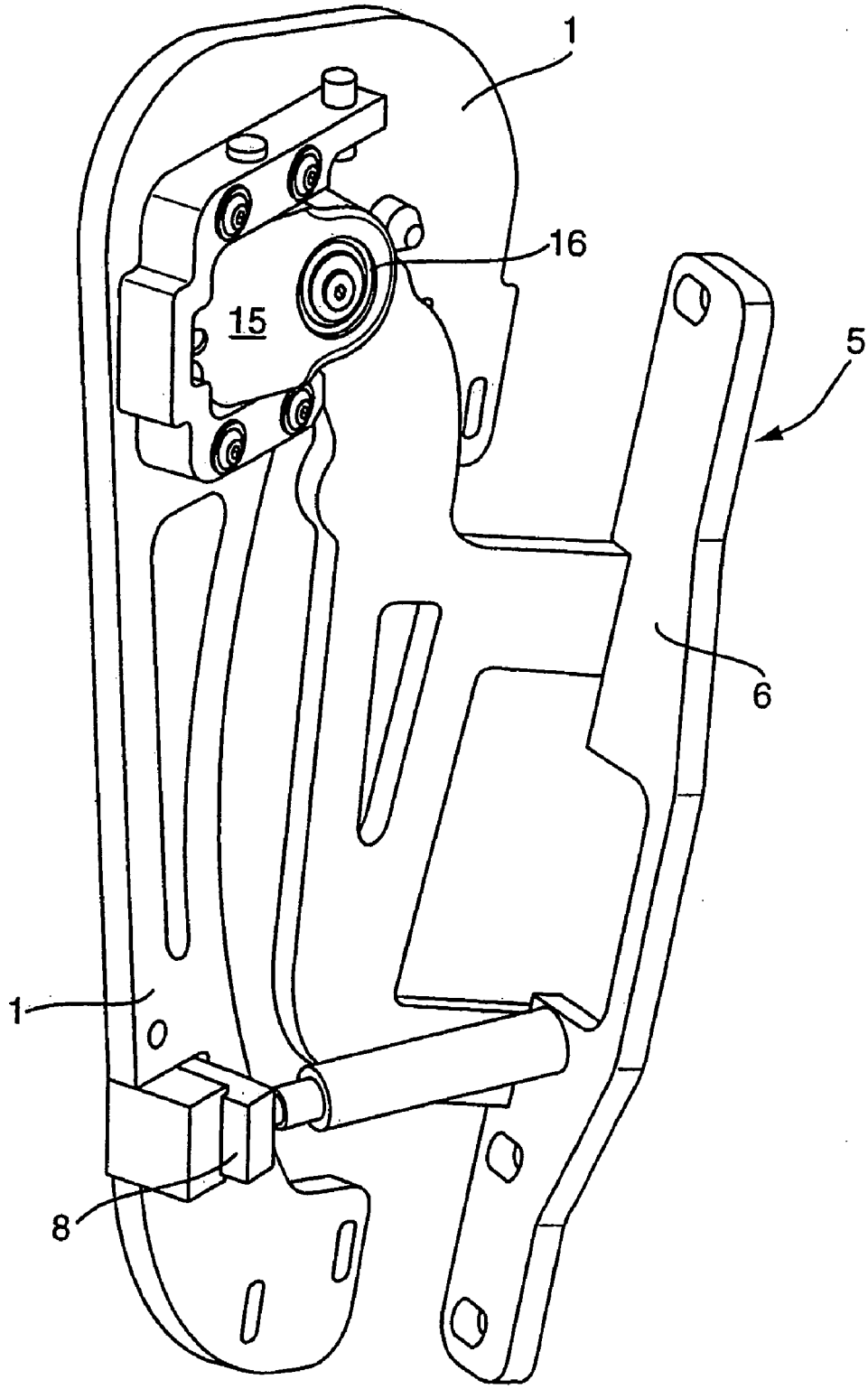
Figure 8:
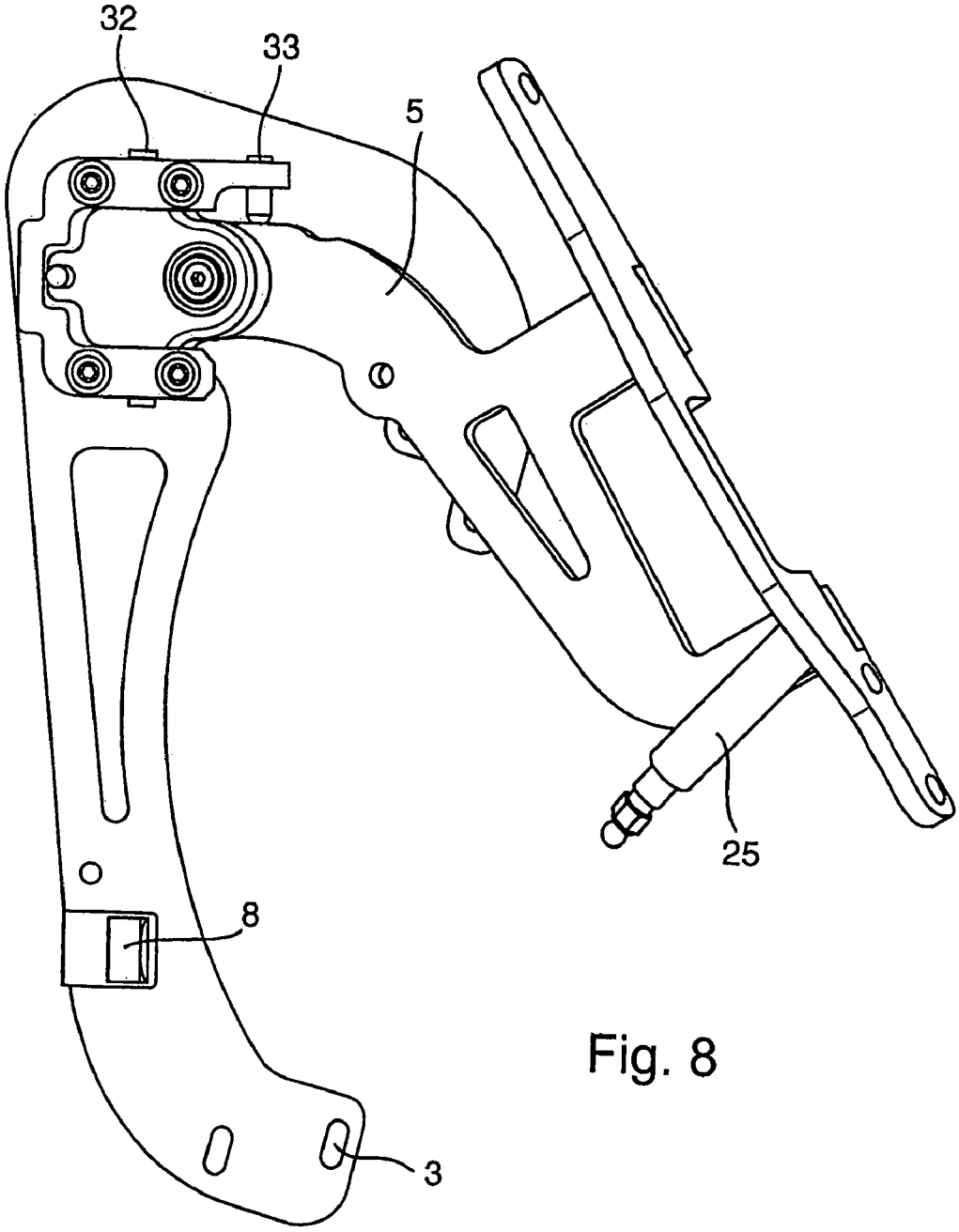
Figure 9:
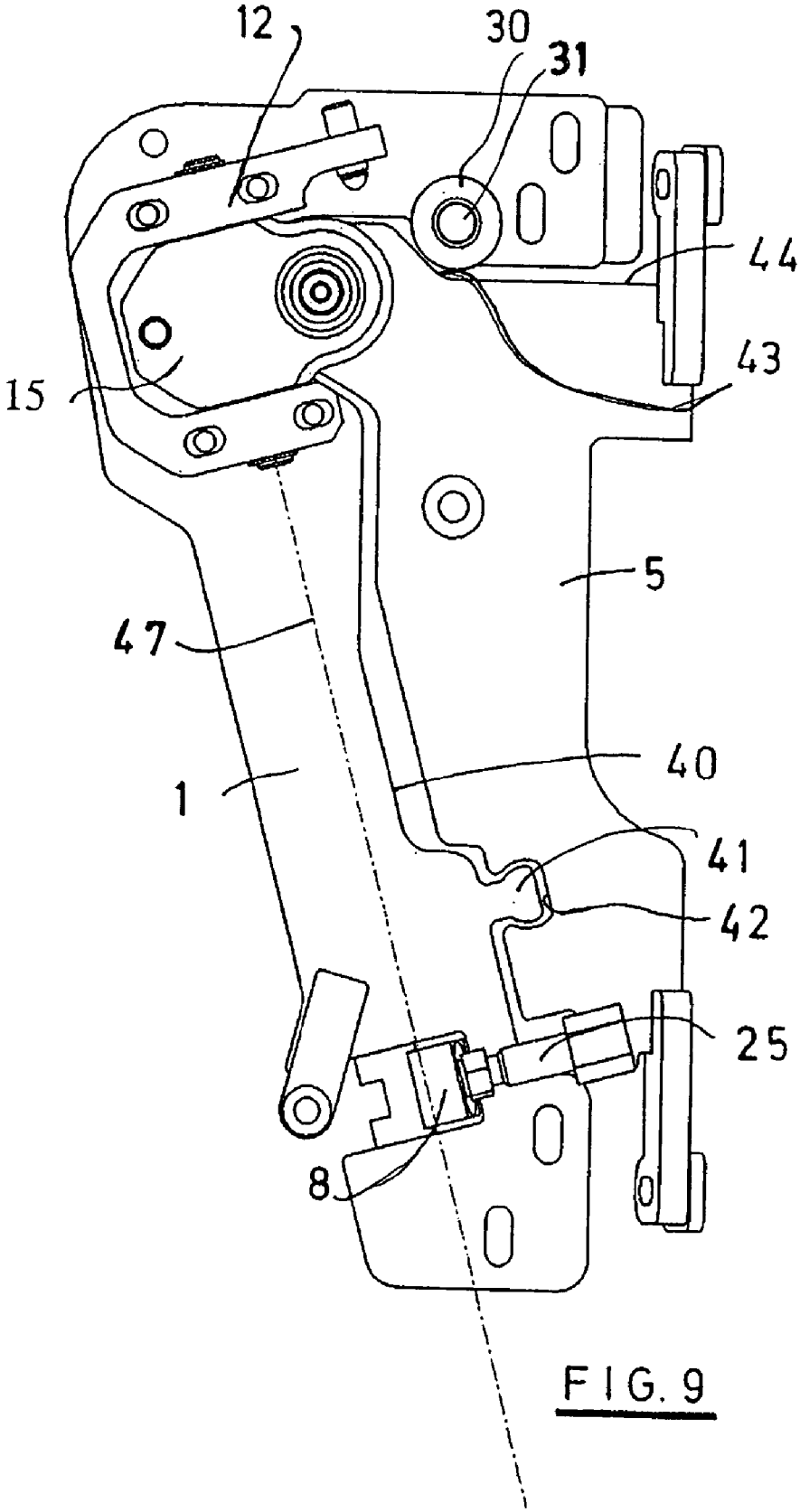
Figure 10:
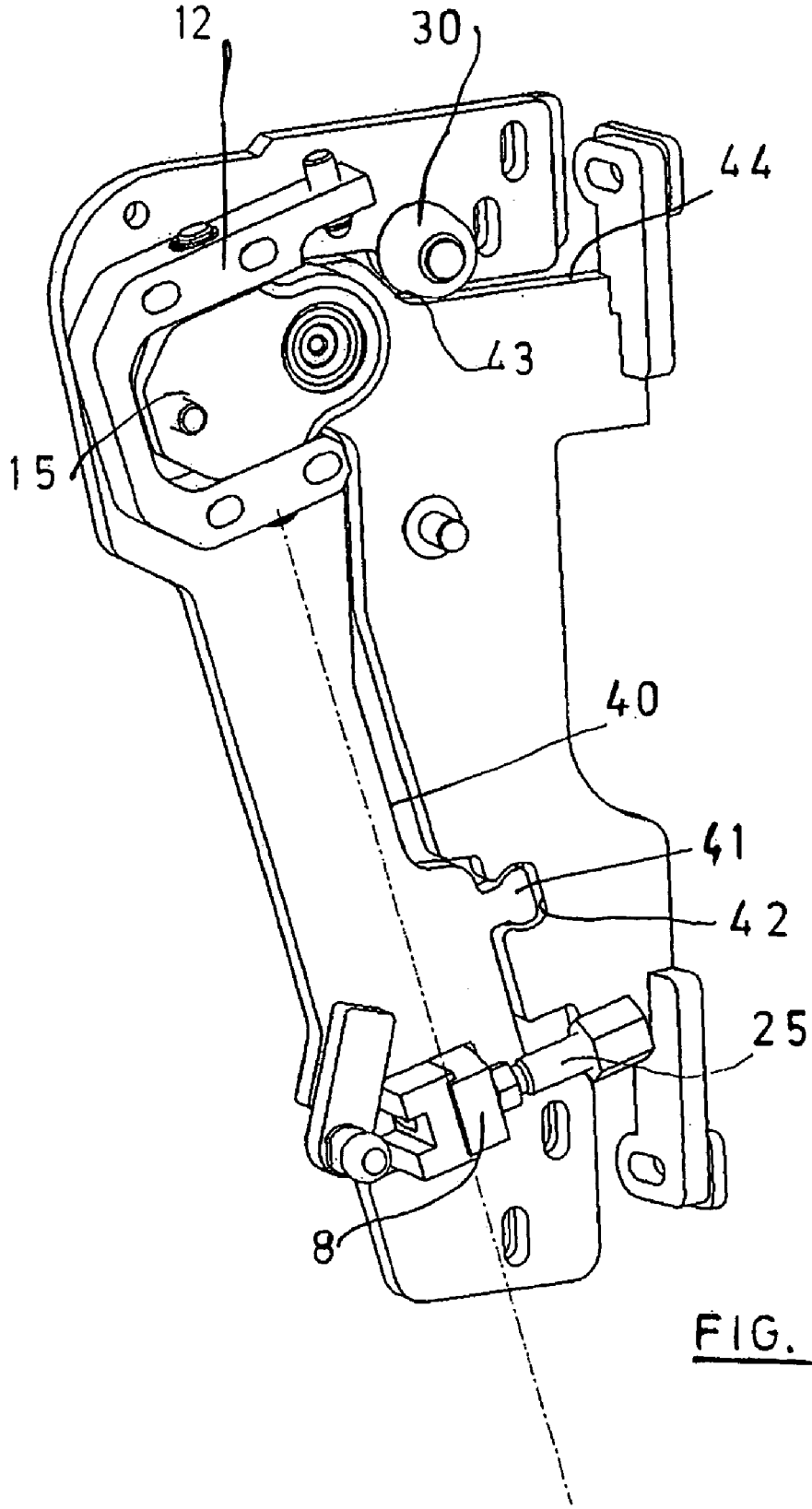
Figure 11:
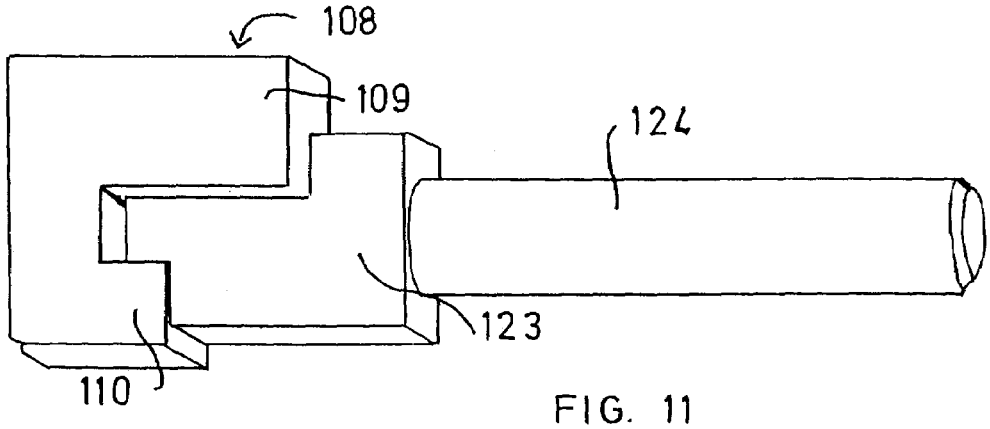
Figure 12:
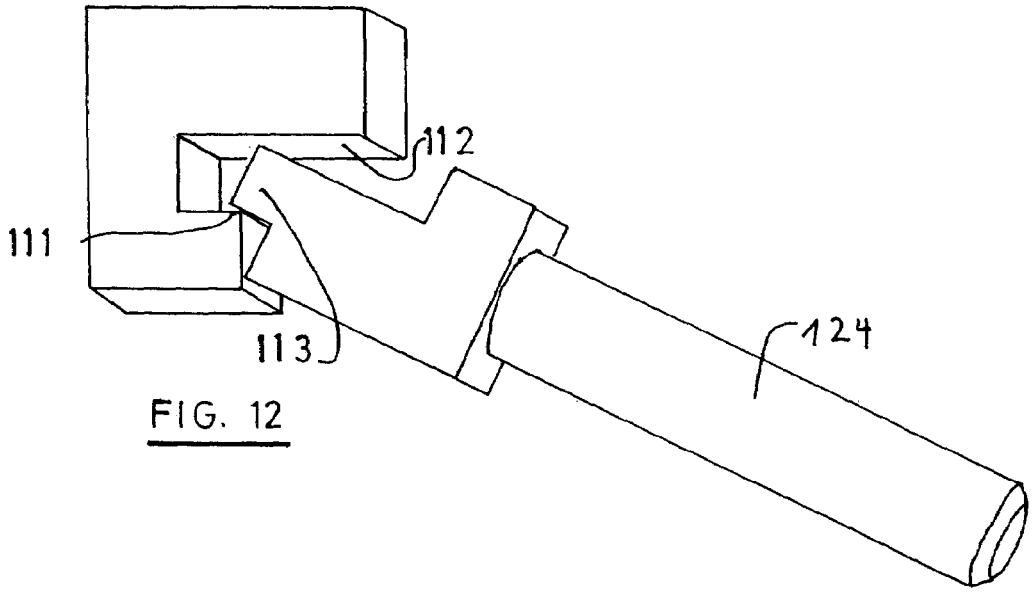
Figure 13:
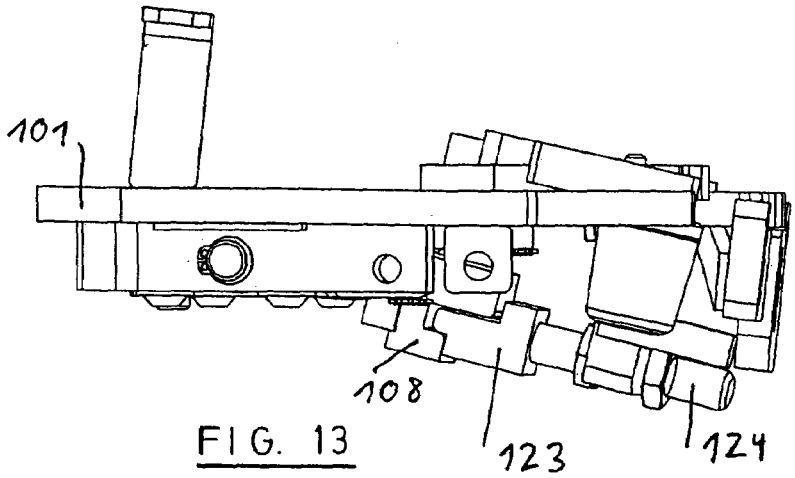

Other features, details, and benefits of the invention will be evident from the claims and the abstract, whose wordings are herewith made an integral part of this description by way of reference thereto, the following description of a preferred embodiment of the invention, as well as the figures, which depict:

FIG. 1 a top view of the two hinge sections forming the hinge, shown here with the linking device removed;

FIG. 2 a view of the linking device that is to be attached to the hinge section to be attached to the bodywork;

FIG. 3 a sectioned view of a component of the linking device, sectioned along the line III—III appearing in FIG. 2;

FIG. 4 a schematized view of the components of the supporting device;

FIG. 5 an end view of a component of the supporting device shown in FIG. 4;

FIG. 6 a perspective drawing of the hinge in the neutral position corresponding to the case where the door is closed;

FIG. 7 a drawing corresponding to that of FIG. 6 for the case where the door has been opened slightly;

FIG. 8 a perspective drawing of the hinge for the case where the linking device is at its fully extended position;

FIG. 9 a top view, similar to that of FIG. 1, of a slightly modified hinge;

FIG. 10 a perspective drawing of the hinge shown in FIG. 9;

FIGS. 11 and 12 views of an embodiment of a supporting device that has been modified relative to the embodiment shown in the foregoing figures;

FIG. 13 a view of the arrangement of the supporting device shown in FIGS. 11 and 12 on the hinge.

FIG. 1 depicts an overview of the pair of basis components of the hinge according to the invention. The hinge contains a hinge section 1 that is bolted onto the motor vehicle's bodywork. In the following, it will also be called "the hinge section intended to be attached to the bodywork." In the vicinity of its lower end 2, it has several slots 3 whose longitudinal axes are vertically oriented. In the vicinity of its upper end, it also has several slots 3 whose longitudinal axes are also vertically oriented. Those slots 3 are arranged such that the hinge section intended to be attached to the bodywork may be bolted on at the locations provided for bolting on factory-standard hinges. The slots provide facilities for adjusting its positioning.

The hinge section 1 intended to be attached to the bodywork is configured in the form a planar component having a constant thickness and is shaped such that it leaves an elongated space 4 free. The hinge section 5 intended to be attached to the door, in particular, that section thereof that is visible in the view shown in FIG. 1, which is configured in the form of a planar component, is accommodated within that space. A vertical plate 6 oriented perpendicular to the plane of the paper that is bolted to the leading edge of the body of the door is attached to that section of the hinge section 5 intended to be attached to the door that is visible in that view. That plate 6 may also have vertically oriented slots in order that adjustments thereof with respect to the door may be performed. While in the position shown, in which that section 5 of the hinge that is correlated to the door, which has just been mentioned, and the section 1 of the hinge that is intended to be attached to the bodywork are arranged such that they lie in the same plane, the two hinge sections are attached to one another using a linking device, which has not been shown in FIG. 1. That linking device is bolted onto the hinge section 1 that is intended to be attached to the bodywork. Four threaded holes 7 are provided for that purpose.

A receptacle 8 for accommodating a supporting device is arranged in the vicinity of the lower end 2 of the hinge section 1 that is intended to be attached to the bodywork.

That receptacle 8 is inserted into a notch 9 on the hinge section 1 and protrudes upward from the planar top surface of the hinge section 1 that is intended to be attached to the bodywork (i.e., toward the front of the motor vehicle).

The hinge section 5 that is intended to be attached to the door has a threaded hole 10 in the vicinity of its upper end that is provided for the purpose of accommodating a shaft forming a linkage axis. That linkage axis defines the axis, about which the hinge section 5 that is intended to be attached to the door may be pivoted using the linking device to be described below.

The hinge section 1 that is intended to be attached to the bodywork contains another threaded hole 11 located near the edge of the space 4, next to the hinge section 5 that is intended to be attached to the door, into which a guiding component may be screwed. That guiding component contains a ball that is free to rotate in the vicinity of its protruding end, against which the hinge section 5 that is intended to be attached to the door may abut. The height of that guiding component, a threaded rod with a ball on one end, may be adjusted in order to accommodate the opening angles of the doors involved.

FIG. 2 depicts an enlarged view, compared to that of FIG. 1, of part of the linking device joining the two hinge sections 1, 5. That linking device contains a first mounting component 12 that is U-shaped and forms the supporting structure for a shaft forming the first linkage axis. That shaft, which has not been shown in FIG. 2, is supported on the two, parallel legs of the mount 12, and runs roughly along the indicated linkage axis 13. Each of the two legs of the mount 12 has a pair of slots 14, through which bolts that are screwed into the threaded holes 7 in the hinge section 1 that is intended to be attached to the bodywork may be inserted. The longitudinal axes of the slots 3 in the hinge section 1 that is intended to be attached to the bodywork are vertically oriented, while the longitudinal axes of the slots 14 are roughly horizontal, which will allow adjusting the lateral positioning of the linkage axis.

The mount 12 carries a bearing block 15 that is free to rotate about that shaft. The angular range about which the bearing block 15 may be pivoted is relatively narrow. The bearing block 15 has a through hole 16 for accommodating the bearing on which it rotates, which is arranged in the aforementioned threaded hole 10 on the hinge section 5 that is intended to be attached to the door. Further details of the bearing block 15 will be evident from FIG. 3, which depicts a longitudinal section through the bearing block 15, taken along the line III—III appearing in FIG. 2. The drilled hole 17 for accommodating the shaft on which it pivots may be seen In FIG. 3. A threaded hole 18, into which a screw may be screwed, is formed on the end of the bearing block 15 opposite the through hole 16 for accommodating the bearing. That screw restricts the pivoting of the bearing block 15 relative to the mount 12 and the hinge section 1 that is intended to be attached to the bodywork due to the fact that the screw is screwed into the bearing block 15 from above, in FIG. 3. The extent to which that pivoting will be restricted will depend upon how far the free end of the screw protrudes from the lower surface 19 of the bearing block 15.

When the bearing block 15 is pivoted about the shaft and out of the mount 12, the through hole 16 for accommodating the bearing will be tilted upward, i.e., toward the viewer, out of the plane of the paper.

FIG. 4 depicts the supporting device mentioned earlier. The supporting device contains the receptacle 8, which has a roughly spherical recess on its right-hand side, in FIG. 4. That recess forms a sort of socket 20. The receptacle 8 has a threaded hole, into which a screw passing through a mounting component 22 may be screwed, beneath the socket 20. The positioning of the receptacle 8 is thus adjustable with respect to the mounting component 22, and thus with respect to the hinge section intended to be attached to the bodywork as well. Those adjustments may also be performed in the reverse order. A ball-head 23 mounted on the end of a threaded rod 24 interacts with the socket 20. The threaded rod 24 is screwed into a sleeve 25 having an internal thread. The length of the assembly may be adjusted by altering the extent to which the threaded rod 24 is screwed into the sleeve 25 with the internal thread. The sleeve with the internal thread is welded onto a land 26 near the bottom of the hinge section 5 intended to be attached to the door. Its longitudinal axis is oriented such that it is normal to the front surface of the receptacle 8. FIG. 4 depicts the arrangement, as viewed from below in FIG. 1.

The arrangement is chosen such that the ball-head 23 will be in the socket 20 when the hinge is in its neutral position, i.e., the position corresponding to the case where the door is closed. The ball-head 23 will remain in the socket 20 when the door is opened, provided that the sole motion that occurs is a pivoting of the bearing block 15 about the shaft retaining it in the mount 12. If, however, the bearing block 15 rotates about the bearing situated in the through hole 16 therein, instead of about the shaft retaining it in the mount 12, the ball-head 23 will be withdrawn from the socket 20. The supporting device also forms a latching mechanism and a fine-adjustment mechanism for setting the preloading of the doors. The height of the supporting device is also adjustable.

Let us now turn to FIG. 6, where the hinge is shown fully assembled. The hinge section attached to the bodywork and the hinge section attached to the door are depicted in the positions shown in FIG. 1, however, in this case, they are linked by the linking device. The guiding component 30 having the ball-head 31 is screwed into the hinge section attached to the bodywork. Only the upper end 32 of the shaft forming the first linkage axis, which protrudes from the mount 12, is visible. A screw 33 that is screwed into the free end of the upper leg of that mount 12 such that its bottom end protrudes from the lower surface of that leg may be seen. That bottom end is situated across from the outer edge of the upper end of the hinge section 5 attached to the door. The ball-head is inserted into the receptacle 8. In order to open the door, the door, together with the hinge section 5 attached to the door, is pivoted about the shaft forming the first linkage axis. The result of that pivoting is shown in FIG. 7. The bearing block 15 has rotated such that the through hole 16 and bearing have been pivoted out of the mount 12. The other end of the bearing block 15 now abuts against the surface of the hinge section 1 attached to the bodywork. This pivoting about the first linkage axis has thus reached the end of its travel.

The only degree of freedom remaining available for the subsequent motion is a pivoting about the bearing inserted into the through hole 16 in the bearing block 15. The door, together with the hinge section 5 attached to the door, is pivoted about this second linkage axis until it reaches the terminal position shown in FIG. 8. The ball-head 23 is withdrawn from the socket 20 as soon as the motion commences. During the remainder of the motion, the rear surface of the hinge section attached to the door abuts against the ball on the end of the threaded rod. In the terminal position shown, the end of the screw 33 abuts against the outer edge of the hinge section 5 attached to the door, which also restricts the latter's travel. That restriction is sensible and necessary in order that the door will not strike the bodywork.

The embodiment shown in FIGS. 9 and 10 differs only slightly from the foregoing embodiment. Therefore, in order to avoid repetitions, only the differences involved will be described. A protrusion 41 that forms an integral part of the hinge section 1 attached to the bodywork, and together therewith is fabricated from a single plate, is formed on that edge 40 of the hinge section 1 attached to the bodywork that faces the hinge section 5 attached to the door, a short distance above the supporting device. The protrusion 41 thus has everywhere the same thickness as the hinge section 1 attached to the bodywork. The width of the protrusion 41 increases with distance from the edge 40 from which it protrudes, i.e., is undercut.

A mating notch 42 that is engaged by the protrusion 41 is cut into in the hinge section 5 that is attached to the door at the same location on the latter. In the position shown in FIG. 9, pivoting of the hinge section 5 attached to the door about the horizontal pivot axis is precluded, even though pivoting in the vicinity of the upper end of the hinge would be possible. The interaction of the protrusion 41 and the notch 42 thus forms an additional latching mechanism that is situated far from the upper, horizontal, pivot axis, which will provide that the door will be securely held in the closed position. However, if the door is opened, i.e., is initially pivoted outward about the linkage axis 43 indicated by the dotted-dashed line, then the notch 42 will leave the plane in which the protrusion 41 lies, which will release the latching mechanism formed by this pair of components.

Of course, the opposite configuration, namely, forming the protrusion 41 on the hinge section 5 intended to be attached to the door, rather than on the hinge section 1 intended to be attached to the bodywork, and forming the notch 42 on the hinge section 1 intended to be attached to the bodywork will also be feasible.

Furthermore, the protrusion 41 and/or the notch 42 might be attached to the front surface and/or rear surface of the respective hinge sections, and the shape of the protrusion and/or notch might be altered.

In the case of the upward pivoting the hinge section 5 attached to the door, together with the door, that is now possible, the aforementioned guiding component 30 and the ball 31 jointly guide the door. As will be evident from FIG. 9, a section 43 of the upper edge 44 of the hinge section 5 attached to the door abuts against the outer surface of the guiding component 30, or is close to it. The outer contour of that guiding component 30 may be configured such that that section 43 of the upper edge 44 of the hinge section 5 attached to the door will glide over it as the latter opens, until the ball bearing 31 finally abuts against the rear surface of the hinge section 5 attached to the door, which will allow providing that the door will be initially accurately transported out of the door frame and then transported upward, without coming into contact with the bodywork anywhere thereon.

When operated in the opposite direction, the guiding component 30 acts such that it will allow proper closing of the door. During closing of the door, it provides that the door cannot be pressed into the door frame too soon, which, under some circumstances, could lead to the door arriving at the closing position from an unsuitable direction, in which case, the guide 30 will also provide that the door drops onto its latch in the correct position.

FIGS. 11–13 depict another option for a supporting device that might be employed instead of the supporting device shown in detail in FIGS. 4 and 5. Since the former supporting device is installed at the same locations on both hinge sections, those particular details thereof will not be described in detail below.

In this case, a receptacle 108 having a rectangular notch is employed instead of the receptacle 8 having a socket 20 that is attached to the hinge section intended to be attached to the bodywork. The receptacle 108 contains a longer leg 109 that faces the hinge section intended to be attached to the bodywork (cf. FIG. 13). A shorter leg 110 that is parallel to that longer leg 109 is formed alongside the longer leg 109.

A head 123 that engages the notch between the longer and shorter legs 109, 110 of the receptacle 108 is arranged on the forward end of the threaded rod 124, which corresponds to the threaded rod 24 of the embodiment shown in FIG. 4. That engagement corresponds to the hinge's closed position. Opening the hinge involves a pivoting about an edge 111 of the shorter leg 110, combined with a simultaneous gliding over the inner surface 112 of the longer leg 109. The opening motion results from a comparison of FIGS. 11 and 12.

When the door is closed, the forward section 113 of the head on the linkage approaches the front surface 112 of the longer leg 109 and reliably slides into the mating notch between the pair of legs 109, 110.

The embodiment shown in FIGS. 11–13 has the benefit that it provides a very secure latching action along a direction of outward motion of the door normal to its surface when it is the closed state. Although the ball-joint solution shown in FIG. 4 also has a good latching action, the embodiment shown in FIGS. 11–13 is preferable in cases where very high forces are exerted and in order to allow for tolerances.

FIG. 13 depicts a side view of the hinge illustrating how the components of the supporting device, namely, the receptacle 108 and the head 123 on the linkage, are attached to the hinge.

The invention claimed is:

1. A hinge for a motor-vehicle door comprising:

a first hinge section (1) intended to be attached to a bodywork, a second hinge section (5) intended to be attached to the door, and a first linking device for attaching the first and second hinge sections (1,5) to one another that has a first linkage having an axis correlated to the first hinge section (1) to be attached to the bodywork and a second linkage having an axis correlated to the second hinge section (5) to be attached to the door, where a position of the axis of the second linkage changes when the first linkage moves from a closed position toward a first open position; and a second linking device arranged at a distance from the first linking device for supporting the second hinge section (5) when the first linking device is in the closed position or the first open position; and wherein the second linking device is in a linking position only while the first linking device is in the closed position or the first open position and wherein the second linking device is disconnected from the first hinge section when the second hinge section is pivoted from the first open position to a second open position.

2. A hinge according to claim 1, wherein two pivot axes of the hinge do not intersect.

3. A hinge according to claim 1, having a guide that at least partially constrains motion of the first linking device such that pivoting of the door will be confined to pivoting about a single axis at a time.

4. A hinge according to claim 1, wherein the axis of the first linkage correlated to the hinge section (1) intended to be attached to the bodywork is roughly parallel to that hinge section (1).

5. A hinge according to claim 1, wherein the orientation of the axis of the first linkage correlated to the hinge section (1) to be attached to the bodywork is adjustable with respect to that hinge section (1).

6. A hinge according to claim 1, wherein the second linking device has a head (23) that may be inserted into a socket (20).

7. A hinge according to claim 1, wherein the hinge section intended to be attached to the bodywork is planar.

8. A hinge according to claim 1, wherein the hinge section (5) intended to be attached to the door has a pair of angled sections, where one of those sections lies in a same plane as the hinge section (1) intended to be attached to the bodywork when the hinge is in a closed position.

9. A hinge according to claim 1 having a gas spring for facilitating the opening motion.

10. A hinge according to claim 1, having a guide for preventing the door from striking the upper door jamb.

11. A hinge according to claim 3, wherein the first linking device has a neutral position corresponding to a case where the door is closed and a terminal position corresponding to a case where the door is fully opened to the second open position.

12. A hinge according to claim 11, wherein the guide is configured such that pivoting of the door will be initially confined to a pivoting about the axis correlated to the hinge section (1) intended to be attached to the bodywork, starting from the aforementioned neutral position of the linking device.

13. A hinge according to claim 11, wherein the guide is configured such that pivoting of the door will be initially confined to a pivoting about the axis correlated to the hinge section (5) intended to be attached to the door, starting from the aforementioned terminal position of the linking device.

14. A hinge according to claim 1, wherein an angular range through which the linking device may be pivoted, about the linkage axis correlated to the hinge section (1) to be attached to the bodywork or about the linkage axis correlated to the hinge section (5) to be attached to the door, is restricted at least one end.

15. A hinge according to claim 14, wherein at least one of a plurality of the constraints on the angular range is adjustable.

16. A hinge according to claim 1, the second linking device, providing an effective latching mechanism situated between the first and second hinge sections (1,5) for latching the lower section of the door in the closed position.

17. A hinge according to claim 16, wherein the second linking device has a protrusion (41) on one of the hinge sections (1) and a mating notch (42) on the other hinge section (5).

18. A hinge according to claim 16, wherein the second linking device prevents a pivoting of the hinge section (5) intended to be attached to the door about its axis.

* * * * *